United States Patent [19]

North

[11] 4,396,391

[45] Aug. 2, 1983

[54] TREATING CELLULOSE TEXTILE FABRICS WITH DIMETHYLOL DIHYDROXYETHYLENEUREA-POLYOL

[75] Inventor: Bernard F. North, Rock Hill, S.C.

[73] Assignee: Sun Chemical Corporation, New York, N.Y.

[21] Appl. No.: 393,640

[22] Filed: Jun. 30, 1982

[51] Int. Cl.[3] ..... D06M 13/34

[52] U.S. Cl. ..... 8/181; 8/182; 8/185; 8/186; 8/261

[58] Field of Search ..... 528/261; 8/181, 182, 8/185, 186

[56] References Cited

U.S. PATENT DOCUMENTS

| | | | |
|---|---|---|---|
| 3,954,405 | 5/1976 | North et al. | 8/186 |
| 4,028,054 | 6/1977 | North et al. | 8/185 |
| 4,108,816 | 8/1978 | Brown et al. | 528/261 |
| 4,163,835 | 8/1979 | Piesch | 528/261 |
| 4,284,758 | 8/1981 | North | 8/185 |
| 4,285,690 | 8/1981 | North | 8/186 |
| 4,300,898 | 11/1981 | North | 8/185 |
| 4,332,586 | 6/1982 | North | 8/186 |
| 4,345,063 | 8/1982 | North | 8/186 |

*Primary Examiner*—A. Lionel Clingman
*Attorney, Agent, or Firm*—Cynthia Berlow

[57] ABSTRACT

The products of the reaction of dimethyloldihydroxyethylene urea (DMDHEU) or an alkylated DMDHEU with a polyol impart permanent press properties to a textile fabric and contain only a small amount of free formaldehyde.

12 Claims, No Drawings

TREATING CELLULOSE TEXTILE FABRICS WITH DIMETHYLOL DIHYDROXYETHYLENEUREA-POLYOL

This invention relates to textile finishing agents. More particularly it relates to finishing resins that impart permanent press characteristics to textile fabrics.

BACKGROUND OF THE INVENTION

The use of thermosetting resins or reactants to impart crease resistance and dimensional stability to textile materials is well-known in the art. These materials, known as "aminoplast resins", include the products of the reaction of formaldehyde with such compounds as urea, thiourea, ethylene urea, dihydroxyethylene urea, melamines, or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

The presence of even less than one percent of free formaldehyde, based on the total weight of the product, is undesirable, not only because of its unpleasant odor, but because it is an allergen and an irritant, causing severe reactions in the operators who manufacture the agent and who treat and handle the treated fabrics and to persons who handle and wear garments fabricated from the treated fabrics.

These problems associated with the presence of free formaldehyde on treated fabrics are well-known, and considerable efforts have been made to produce formaldehyde-free textile fabrics. One solution to the problem has been to employ scavengers for the free formaldehyde. In U.S. Pat. No. 3,590,100 cyclic ethylene urea and propylene urea are disclosed as scavengers. Removal of the formaldehyde by reaction with phthalimide is disclosed in U.S. Pat. No. 3,723,058. U.S. Pat. No. 4,127,382 teaches certain nitrogen-containing heterocyclic compounds as scavengers.

Treating textiles with resin compositions that do not contain or evolve formaldehyde is also known, as in U.S. Pat. No. 3,260,565, which teaches finishing agents formed by the reaction of alkyl or aryl ureas or thiourea with glyoxal. These agents, however, have the disadvantage of having marginal permanent press properties.

Other non-formaldehyde or low-formaldehyde materials such as alkylated condensates or glyoxal and cyclic urea (U.S. Pat. No. 4,284,758) and blends of a condensate of glyoxal and a cyclic urea with dimethyloldihydroxyethylene urea (U.S. Pat. No. 4,300,898) are used to impart permanent press properties to a textile fabric.

SUMMARY OF INVENTION

It has now been found that the products of the reaction of dimethyloldihydroxyethylene urea (DMDHEU) or alkylated DMDHEU and a polyol are excellent crosslinking resins for textile fabrics and have a low potential for formaldehyde release.

DETAILED DESCRIPTION OF THE INVENTION

In accordance with the present invention, novel products are prepared by reacting DMDHEU or alkylated DMDHEU with a polyol. Suitable polyols include, but are not limited to ethylene glycol, diethylene glycol, 1,2-propylene glycol, 1,3-propylene glycol, 1,2-butylene glycol, 1,3-butylene glycol, 1,4-butylene glycol, polyethylene glycols having the formula $HO(CH_2CH_2O)_nH$ where n is 1 to about 50, glycerine, and the like, and their mixtures.

The dimethyloldihydroxyethylene urea (DMDHEU) may be used per se or it may be wholly or partially alkylated, such as methylated DMDHEU.

The DMDHEU and the polyol are generally reacted in a ratio of about 1-0.2:1-6 DMDHEU:polyol, and preferably the range is about 1-0.5:1-3.0 DMDHEU:polyol. The reaction may be carried out within the temperature range of about 10° to 100° C., and preferably within the range of about 50° to 80° C. for about 1 to 18 hours, and preferably for about 2 to 6 hours. The pH may range from about 1.0 to 6.0, and preferably it is within the range of about 2.0 to 4.0.

The pH may be adjusted with any suitable and convenient acid, such as for example sulfuric acid, nitric acid, phosphoric acid, hydrochloric acid; an organic acid such as citric acid; or the like; or their mixtures.

The product is a clear white to straw colored liquid generally used as an aqueous or alcohol solution.

The products of this invention are suitable for use with cellulosic textile fabrics, woven or non-woven, including 100% cellulose fabrics, e.g., cotton, rayon, and linen, as well as blends, e.g., polyester/cotton or polyester/rayon. Such blends preferably but not necessarily contain at least 20% of cellulose. Both white and colored (printed, dyed, yarn-dyed, cross-dyed, etc.) fabrics can be effectively treated with the resins of this invention. They are applicable also to fabrics containing fibers with free hydroxyl groups.

When applying the compositions of this invention to a fabric, there generally will be present an appropriate catalyst. Typical catalysts include acids (such as hydrochloric, sulfuric, fluoboric, acetic, glycolic, maleic, lactic, citric, tartaric, and oxalic acids); metal salts (such as magnesium chloride, nitrate, fluoborate, or fluosilicate; zinc chloride, nitrate, fluoborate, or fluosilicate; zirconium oxychloride; sodium or potassium bisulfate); ammonium chloride; amine hydrochlorides (such as the hydrochloride of 2-amino-2-methyl-1-propanol); and the like, and mixtures thereof. The amount of catalyst generally is about 0.01 to 10 percent, and preferably about 0.05 to 5 percent, based on the weight of the padding bath.

The finishing agents may be applied to the textile fabric in any known and convenient manner, e.g., by dipping or padding, and will generally be applied from an aqueous or alcoholic solution. The solvent may be water; an aliphatic alcohol, e.g., methanol, ethanol, or isopropanol; or a mixture of water and an aliphatic alcohol. Other conventional additives such as lubricants, softeners, bodying agents, water repellents, flame retardants, soil shedding agents, mildew inhibitors, antiwet soiling agents, fluorescent brighteners, and the like may be used in the treating bath in conventional amounts. Such auxiliaries must not, however, interfere with the proper functioning of the finishing compositions, must not themselves have a deleterious effect on the fabric, and desirably are free of formaldehyde.

The amount of treating agent which is applied to the fabric will depend upon the type of fabric and its intended application. In general it is about 0.5 to 10 percent, and preferably about 2 to 5 percent, based on the weight of the fabric.

In the process of treating fabrics with the products of this invention, the fabric is impregnated with an aqueous or alcoholic solution of the finishing resins, and the impregnated fabric is then dried and cured; the drying and curing steps may be consecutive or simultaneous.

If desired, the textile fabric may be finished by post-curing (also known as deferred or delayed curing). This consists of impregnating the fabric with a solution of the finishing resins and catalyst, drying the impregnated material carefully so that the finishing agent does not react, and then, after a prolonged interval, heating the material to a temperature at which the agent reacts under the influence of the catalyst.

Although this invention will be described with the use of a product of the reaction of DMDHEU or alkylated DMDHEU with a polyol as a textile finishing agent, it is not intended to be limited thereto. It is also suitable for use as an insolubilizer for binders in paper coatings; a dry-strength or a wet-strength resin in paper; a hand-builder in textiles; a binder in particle board, medium-density fiber board, plywood, foundry and shell moldings, insulation materials including glass fiber mats, friction materials, coated and bonded abrasives, etc.; a component in molding compounds; an adhesive for wood and laminates; a film-forming resin in coatings and printing inks; an additive in fibers, e.g., rayon; an additive in rubber processing; an agent in leather tanning; a textile size; a dry fixative for textiles; an impregnant for filters, e.g., automotive filters; and the like.

In order that the present invention may be more fully understood, the following examples are given by way of illustration. No specific details contained therein should be construed as limitations on the present invention except insofar as they appear in the appended claims. Unless otherwise specified, all parts and percentages are by weight.

EXAMPLE 1

(A) 600 Parts of a 54% DMDHEU solution (1.82 moles), 200 parts of diethylene glycol (1.89 moles), and 200 parts of water were acidified with sulfuric acid to a pH of 3.0 and heated for four hours at 70° C. The product was a clear pale straw colored liquid with a very slight odor of formaldehyde. The degree of reaction was determined by HPLC (high performance liquid chromatography).

(B) The product of part (A) was used to treat 100% cotton fabric, as follows:

A solution of 15 parts of the product, 3.75 parts of Catalyst 531 (Sun Chemical Corporation's activated magnesium chloride catalyst), and 0.25 part of Sulfanole® RWD (Sun Chemical Corporation's non-ionic wetting agent) was applied to the fabric by padding at a wet pick-up of 58%, based on the weight of the fabric. The treated fabric was dried for three minutes at 225° F. and cured, one sample (I) for 90 seconds at 300° F. and a second sample (II) for 90 seconds at 340° F., except for determining chlorine scorch where the fabric was dried for five minutes at 225° F. and cured for 60 seconds at 340° F.

The fabric was tested for wrinkle recovery angle, tensile strength, chlorine scorch, whiteness display, and formaldehyde on fabric. The results are in Table I below.

(C) The procedure of part (B) was repeated except that the fabric was 65/35 cotton/polyester. The treated fabric was tested for fabric smoothness and formaldehyde on product. The results are in Table II below.

Wrinkle Recovery was measured by AATCC Test Method 66-1978 "Wrinkle Recovery of Fabrics: Recovery Angle Method".

Tensile was measured by ASTM Test Method D-1682-64 (Reapproved 1975) "Tensile-Grab-CRT Pendulum Type".

Fabric smoothness was determined by AATCC Test Method 124-1978 "Appearance of Durable Press Fabrics after Repeated Home Launderings".

Chlorine scorch was determined by AATCC Test Method 114-1977 "Chlorine Retained, Tensile Loss: Multiple Sample Method".

EXAMPLE 2

The procedure of Example 1 parts (A and B) was repeated except than the 200 parts of water was replaced by an additional 200 parts of diethylene glycol, that is, a total of 3.78 moles of diethylene glycol. The product was a clear pale straw colored liquid with a very slight odor of formaldehyde. It was determined by HPLC to have a greater degree of reaction than the product of Example 1.

EXAMPLE 3

The procedures of Example 1 and 2 (part A) were repeated except that the DMDHEU was replaced by MeDMDHEU. The product was similar.

EXAMPLE 4

The procedure of Examples 1 and 2 (part A) were repeated except that the diethylene glycol was replaced by each of the following polyols: ethylene glycol, 1,2-propylene glycol, 1,4-butylene glycol, and glycerine. The results were comparable.

EXAMPLE 5 (comparative)

To illustrate the need to pre-react the DMDHEU and the polyol under acidic conditions so that etherification can occur, the following runs were made:

(A) 600 Parts of DMDHEU, 200 parts of diethylene glycol, and 200 parts of water were mixed, applied to a fabric, and tested as in Example 1 (parts B and C). The results are in Tables I and II below.

(B) 600 Parts of DMDHEU and 400 parts of diethylene glycol were mixed, applied to a fabric, and tested as in Example 1 (parts B and C). The results are in Tables I and II below.

EXAMPLE 6 (comparative)

The procedure of Example 1 (part B) was repeated except that the fabric was treated with diethylene glycol instead of a product of this invention.. There was no change in the properties of the fabric, that is, the diethylene glycol imparted no resistance to wrinkling and did not improve fabric smoothness.

EXAMPLE 7 (comparative)

The procedure of Example 1 (part B) was repeated except that the fabric was treated with DMDHEU and with MeDMDHEU instead of a product of this invention. The results are in Table I below. In addition, the whiteness of fabrics treated with the product of Example 1 (Part A) was comparable to that of fabrics treated with DMDHEU.

TABLE I

| | (a) | (b) | (c) | (d) | (e) | (f) | (g) |
|---|---|---|---|---|---|---|---|
| Wrinkle Recovery initial | | | | | | | |
| Cure I | 262 | 269 | 266 | 266 | 253 | | 180 |
| Cure II | 269 | 270 | 279 | 275 | 267 | | 183 |
| Wrinkle Recovery after 5 AHL | | | | | | | |
| Cure I | 263 | 272 | 266 | 261 | 252 | | 174 |
| Cure II | 263 | 270 | 275 | 270 | 266 | | 182 |
| Tensile | | | | | | | |
| Cure I W | 50 | 46 | 42 | 60 | 60 | | 82 |
| F | 12 | 10 | 18 | 16 | 25 | | 27 |
| Cure II W | 36 | 29 | 40 | 48 | 57 | | 74 |
| F | 9 | 8 | 13 | 13 | 17 | | 27 |
| Free Formaldehyde, ppm | | | | | | | |
| Cure I | 170 | 80 | 240 | 140 | 300 | | |
| Cure II | 110 | 90 | 160 | 110 | 320 | | |
| Retained Chlorine, Tensile Loss, % | | | | | | | |
| initial | 2.0 | | | | | 31.9 | |
| after 5 AHL | 2.5 | | | | | 33.3 | |
| after 5 hydrolysis washes | 8.5 | | | | | 75.0 | |

(a) is a fabric treated with the product of Example 1 (A)
(b) is a fabric treated with the product of Example 2
(c) is a fabric treated with the product of Example 5 (A)
(d) is a fabric treated with the product of Example 5 (B)
(e) is a fabric treated with methylated dimethyloldihydroxyethylene urea (MeDMDHEU)
(f) is a fabric treated with dimethylolhydroxyethylene urea (DMDHEU)
(g) is untreated cotton
AHL is automatic home launderings
Cure I is 90 seconds at 300° F. and Cure II is 90 seconds at 340° F.

TABLE II

| | (a) | (b) | (c) | (d) | (e) | (g) |
|---|---|---|---|---|---|---|
| Fabric Smoothness | | | | | | |
| after 1 AHL | | | | | | |
| Cure I | 3.3 | 3.3 | 3.6 | 3.3 | 3.3 | 2.8 |
| Cure II | 3.5 | 3.1 | 3.6 | 3.3 | 3.4 | 2.5 |
| after 5 AHL | | | | | | |
| Cure I | 3.4 | 3.2 | 3.4 | 3.5 | 3.4 | 2.9 |
| Cure II | 3.4 | 3.3 | 3.4 | 3.4 | 3.3 | 2.9 |
| Free formaldehyde, ppm | | | | | | |
| Cure I | 90 | 20 | 140 | 100 | 260 | |

TABLE II-continued

| | (a) | (b) | (c) | (d) | (e) | (g) |
|---|---|---|---|---|---|---|
| Cure II | 60 | 20 | 90 | 50 | 190 | |

(a) is a fabric treated with the product of Example 1 (A)
(b) is a fabric treated with the product of Example 2
(c) is a fabric treated with the product of Example 5 (A)
(d) is a fabric treated with the product of Example 5 (B)
(e) is a fabric treated with MeDMDHEU
(g) is untreated 65/35 polyester/cotton
Cure I is 90 seconds at 300° F. and Cure II is 90 seconds at 340° F.

From the data in Tables I and II it will be seen that the fabrics treated with the products of this invention (a) and (b) are comparable in wrinkle recovery, tensile strength, and fabric smoothness to fabrics treated with the commercial formaldehyde-containing agent (e) and have the advantage of having less formaldehyde than the commercial agent and the mixtures of DMDHEU and diethylene glycol (c) and (d). The chlorine resistance of a fabric treated with a product of this invention (a) is better than that of a fabric treated with DMDHEU (f).

What is claimed is:

1. A composition for treating a cellulose textile fabric which comprises the product of the reaction of (a) dimethyloldihydroxyethylene urea or an alkylated dimethyloldihydroxyethylene urea with (b) a polyol.

2. The product of claim 1 wherein the ratio of amounts of (a):(b) is about 1–0.2:1–6.

3. The product of claim 1 wherein the ratio of amounts of (a):(b) is about 1–0.5:1–3.0.

4. The product of claim 1 wherein the polyol is diethylene glycol.

5. The product of claim 1 wherein the polyol is ethylene glycol.

6. A process for producing a crease-resistant cellulose textile fabric which comprises impregnating a textile with a solution of the composition of claim 1 and a catalyst and heating the impregnated textile to cure the composition thereon.

7. A crease-resistant cellulose textile fabric produced by the process of claim 6.

8. The product of the reaction of (a) dimethyloldihydroxyethylene urea or an alkylated dimethyloldihydroxyethylene urea with (b) a polyol.

9. The product of claim 8 wherein the polyol is diethylene glycol.

10. The product of claim 8 wherein the polyol is ethylene glycol.

11. A process for preparing the product of claim 8 which comprises reacting (a) dimethyloldihydroxyethylene urea or an alkylated dimethyloldihydroxyethylene urea with (b) a polyol at about 10° to 100° C. for about 1 to 18 hours at a pH of about 1.0 to 6.0.

12. The process of claim 11 wherein (a) and (b) are reacted at a temperature within the range of about 50° to 80° C. for about 2 to 6 hours at a pH of about 2.0 to 4.0.

* * * * *

REEXAMINATION CERTIFICATE (239th)

United States Patent [19]

North

[11] B1 4,396,391

[45] Certificate Issued Aug. 28, 1984

[54] TREATING CELLULOSE TEXTILE FABRICS WITH DIMETHYLOL DIHYDROXYETHYLENEUREA-POLYOL

[75] Inventor: Bernard F. North, Rock Hill, S.C.

[73] Assignee: Sun Chemical Corporation, New York, N.Y.

Reexamination Request:
No. 90/000,489, Jan. 23, 1984

Reexamination Certificate for:

| | |
|---|---|
| Patent No.: | **4,396,391** |
| Issued: | **Aug. 2, 1983** |
| Appl. No.: | **393,640** |
| Filed: | **Jun. 30, 1982** |

[51] Int. Cl.[3] ..... D06M 13/34

[52] U.S. Cl. ..... 8/181; 8/182; 8/185; 8/186; 8/261

[56] References Cited

U.S. PATENT DOCUMENTS 3,652,583 3/1972 Tajima et al. ..... 260/309.7

OTHER PUBLICATIONS

"Lowering Formaldehyde Release With Polyols", B. A. Kottes Andrews et al., *Textile Chemist and Colorist*, v. 12, No. 11: 287/25–291/29, (Nov. 1980).

*Primary Examiner*—Paul R. Michl
*Attorney, Agent, or Firm*—Cynthia Berlow

[57] ABSTRACT

The products of the reaction of dimethyloldihydroxyethylene urea (DMDHEU) or an alkylated DMDHEU with a polyol impart permanent press properties to a textile fabric and contain only a small amount of free formaldehyde.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6 and 7 is confirmed.

Claims 1, 8 and 11 are determined to be patentable as amended.

Claims 2–5, 9, 10 and 12, dependent on an amended claim, are determined to be patentable.

1. A composition for treating a textile fabric which comprises the product of the reaction of (a) dimethyloldihydroxyethylene urea or an alkylated dimethyloldihydroxyethylene urea with (b) a polyol *selected from the group consisting of ethylene glycol, diethylene glycol, propylene glycols, butylene glycols, and glycerine, and their mixtures.*

8. The product of the reaction of (a) dimethyloldihydroxyethylene urea or an alkylated dimethyloldihydroxyethylene urea with (b) a polyol *selected from the group consisting of ethylene glycol, diethylene glycol, propylene glycols, butylene glycols, and glycerine, and their mixtures.*

11. A process for preparing the product of claim 8 which comprises reacting (a) dimethyloldihydroxyethylene urea or an alkylated dimethyloldihydroxyethylene urea with (b) a polyol at about 10° to 100° C. for about 1 to 18 hours at a pH of about 1.0 to 6.0, *said polyol being selected from the group consisting of ethylene glycol, diethylene glycol, propylene glycols, butylene glycols, and glycerine, and their mixtures.*

* * * * *

US004396391B1

REEXAMINATION CERTIFICATE (1946th)

United States Patent [19]

North

[11] B2 4,396,391

[45] Certificate Issued Mar. 16, 1993

[54] TREATING CELLULOSE TEXTILE FABRICS WITH DIMENTHYLOL DIHYDROYETHYLENEUREE-POLYOL

[75] Inventor: Bernard F. North, Rock Hill, S.C.

[73] Assignee: Sequa Chemicals, Inc., New York, N.Y.

Reexamination Request:
No. 90/002,687, Apr. 2, 1992

Reexamination Certificate for:
Patent No.: 4,396,391
Issued: Aug. 2, 1983
Appl. No.: 393,640
Filed: Jun. 30, 1982

Reexamination Certificate B1 4,396,391 issued Aug. 28, 1984.

[51] Int. Cl.[5] ..... D06M 13/34
[52] U.S. Cl. ..... 8/181; 8/182; 8/185; 8/186; 8/261

[58] Field of Search ..... 8/181, 182, 185, 186

[56] References Cited

U.S. PATENT DOCUMENTS 2,764,573 9/1956 Reibnitz et al. ..... 8/182

FOREIGN PATENT DOCUMENTS 627447 1/1963 Belgium .
19102 11/1980 European Pat. Off. .
1172265 6/1964 Fed. Rep. of Germany .

OTHER PUBLICATIONS

B. A. Kottes Andrews et al, Textile Chemist and Colorist, 1980, vol. 12, No. 11, pp. 287/25-291/29.

*Primary Examiner*—A. L. Clingman
*Attorney, Agent, or Firm*—Cynthia Berlow

[57] ABSTRACT

The products of the reaction of dimethyloldihydroxyethylene urea (DMDHEU) or an alkylated DMDHEU with a polyol impart permanent press properties to a textile fabric and contain only a small amount of free formaldehyde.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATTION, IT HAS BEEN DETERMINED THAT:

Claims 1 and 8 are determined to be patentable as amended.

Claims 2-7 and 9-12, dependent on an amended claim, are determined to be patentable.

1. A composition for treating a textile fabric which comprises the product of the reaction of (a) dimethyloldihydroxyethylene urea or an alkylated dimethyloldihydroxyethylene urea with (b) a polyol selected from the group consisting of ethylene glycol, diethylene glycol, propylene glycols, butylene glycols, and glycerine, and their mixtures, *carried out at a pH of about 1.0 to 6.0 in aqueous solution.*

8. The product of the reaction of (a) dimethyloldihydroxyethylene urea or an alkylated dimethyloldihydroxyethylene urea with (b) a polyol selected from the group consisting of ethylene glycol, diethylene glycol, propylene glycols, butylene glycols, and glycerine, and their mixtures, *carried out at a pH of about 1.0 to 6.0 in aqueous solution.*

* * * * *